US011046921B2

(12) United States Patent
Ceulemans et al.

(10) Patent No.: US 11,046,921 B2
(45) Date of Patent: Jun. 29, 2021

(54) ANTIMICROBIAL CLEANING COMPOSITION COMPRISING AN N-METHYL GLUCAMINE

(71) Applicant: The Procter & Gamble Company, Cincinnati, OH (US)

(72) Inventors: Raphael Angeline Alfons Ceulemans, Holsbeek (BE); Patrick Firmin August Delplancke, Steenhuize-Wijnhuize (BE); Neil Thomas Fairweather, Liberty Township, OH (US); Eva Maria Perez-Prat Vinuesa, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 51 days.

(21) Appl. No.: 16/059,066

(22) Filed: Aug. 9, 2018

(65) Prior Publication Data

US 2019/0055500 A1 Feb. 21, 2019

(30) Foreign Application Priority Data

Aug. 16, 2017 (EP) ..... 17186365
Apr. 11, 2018 (EP) ..... 18166716

(51) Int. Cl.

| | |
|---|---|
| ***C11D 3/30*** | (2006.01) |
| ***C11D 3/48*** | (2006.01) |
| ***C11D 1/44*** | (2006.01) |
| ***C11D 1/645*** | (2006.01) |
| ***C11D 1/66*** | (2006.01) |
| ***C11D 11/00*** | (2006.01) |
| *C11D 1/62* | (2006.01) |

(52) U.S. Cl.

CPC ..... *C11D 3/48* (2013.01); *C11D 1/44* (2013.01); *C11D 1/645* (2013.01); *C11D 1/66* (2013.01); *C11D 3/30* (2013.01); *C11D 11/0023* (2013.01); *C11D 1/62* (2013.01)

(58) Field of Classification Search

CPC .... C11D 1/62; C11D 1/75; C11D 3/30; C11D 3/48; C11D 7/3209; C11D 11/0023

See application file for complete search history.

(56) References Cited

U.S. PATENT DOCUMENTS

| | | | | |
|---|---|---|---|---|
| 2011/0166236 | A1 | 7/2011 | Tangestani-nejad | |
| 2014/0343157 | A1 | 11/2014 | Griese | |
| 2015/0125415 | A1 | 5/2015 | Klug et al. | |
| 2015/0126424 | A1 | 5/2015 | Klug et al. | |
| 2015/0133560 | A1 | 5/2015 | Klug et al. | |
| 2015/0140048 | A1 | 5/2015 | Klug et al. | |
| 2015/0141466 | A1 | 5/2015 | Klug et al. | |
| 2015/0141508 | A1 | 5/2015 | Klug et al. | |
| 2015/0150767 | A1 | 6/2015 | Klug et al. | |
| 2015/0164755 | A1* | 6/2015 | Klug | A61K 8/42 510/125 |
| 2016/0136072 | A1* | 5/2016 | Klug | C11D 1/90 510/159 |
| 2016/0143828 | A1 | 5/2016 | Klug et al. | |
| 2016/0361243 | A1* | 12/2016 | Klug | A61K 8/41 |
| 2017/0002297 | A1* | 1/2017 | Klug | C11D 1/126 |
| 2017/0218293 | A1* | 8/2017 | Klug | C10M 173/00 |
| 2018/0051234 | A1 | 2/2018 | Delplancke et al. | |

FOREIGN PATENT DOCUMENTS

| | | | |
|---|---|---|---|
| EP | 1001012 | A1 | 5/2000 |
| WO | WO9628458 | A1 | 9/1996 |
| WO | WO9919432 | A1 | 4/1999 |
| WO | WO9928423 | A1 | 6/1999 |
| WO | WO2015120990 | A1 | 8/2015 |

OTHER PUBLICATIONS

Extended European Search Report; Application No. 17186365.7-1105; dated Feb. 22, 2018; 9 pages.

Extended European Search Report and Search Opinion: Application Ser No. 18166716.3; dated Oct. 23, 2018; 7 pages.

International Search Report and Written Opinion; Application Ser. No. PCT/US2018/043995; dated Nov. 13, 2018, 11 pages.

Kawada K et al, "Surface Activities Biodegradability and Antimicrobial Properties of N-Alkyl Glycosylamines", In Journal of American Oil Chemists' Society, Feb. 1, 1994, vol. 22, Issue 2, pp. 69-75.

* cited by examiner

*Primary Examiner* — Charles I Boyer
(74) *Attorney, Agent, or Firm* — John T. Dipre

(57) ABSTRACT

The need for an antimicrobial hard surface cleaning composition providing good antimicrobial efficacy, even at low levels of the antimicrobial agent, while also providing improved surface shine, is met by formulating the composition with an antimicrobial active and an amine.

5 Claims, No Drawings

ANTIMICROBIAL CLEANING COMPOSITION COMPRISING AN N-METHYL GLUCAMINE

FIELD OF THE INVENTION

Antimicrobial hard surface cleaning compositions comprising an antimicrobial active and an amine, providing improved antimicrobial efficacy and less visible residues or streaks on the treated surface.

BACKGROUND OF THE INVENTION

Hard surface cleaning compositions are used for cleaning and treating hard surfaces. Preferably, the hard surface cleaning composition is formulated to be an "all purpose" hard surface cleaning composition. That is, the hard surface cleaning composition is formulated to be suitable for cleaning as many different kinds of surfaces as possible.

For treating surfaces where high levels of hygiene is desired, such as kitchen, toilets, bathrooms, and surfaces that small infants can come into contact with, it is desirable that the hard surface cleaning composition comprises an antimicrobial agent such as a quaternary ammonium compound. However, antimicrobial agents typically form mixed micelles with the cleaning surfactants present in the composition. The result is that the antimicrobial efficacy of the composition is reduced, or else, higher levels of the antimicrobial active must be present.

Moreover, the antimicrobial active tends to be deposited on the surface as a visible residue, which leaves the user with an impression that the treated surface has not been cleaned well. This is because the surface appears streaky and has poor shine. Moreover, the treated surface can feel slightly sticky, which further leaves an impression with the user of poor cleaning.

In addition, antimicrobial hard surface cleaning compositions comprising antimicrobial quaternary ammonium compounds are often formulated at high pH (10.5-11.5) to maximize efficacy against gram negative bacteria such as *Pseudomonas aeruginosa* or *Escherichia coli* as the quaternary ammonium compounds are less effective against these types of bacteria than against gram positive bacteria such as *Staphylococcus aureus*. This results in antimicrobial hard surface cleaning compositions that are not suitable for use in all surface types, particularly on delicate surfaces such as wood, quartz, and natural stone such as granite or marble.

Therefore, a need remains for an antimicrobial hard surface cleaning composition providing good antimicrobial efficacy on all surface types, including delicate surfaces, even at low levels of the antimicrobial agent, while also providing improved surface shine.

EP application 16184415.4 relates to a hand dishwashing cleaning composition comprising a surfactant system and an amine of formula: R1-N—(R2)(CH2CHOH(CH2O)nR3), wherein R1 and R2 are independently selected from hydrogen, cyclic or acyclic, linear or branched C1 to C10 alkyl, C1 to C10 hydroxyalkyl, polyhydroxyhydrocarbyl and polyalkoxy of formula (R4-O)xH with R4 being C1-C4 and x is from 1 to 15; n is 0 or 1, preferably 1; and R3 is a C6 to C30 hydrocarbyl.

WO02015120990 relates to the use of N-methyl-N-acylglucamines in compositions for cleaning hard surfaces, having a pH value <6, the proportion of the glucamines with C8-C14-acyl groups being at least 80 wt. % and the proportion of glucamines with C8-C10-acyl groups is more than 50 wt. %, respectively in relation to the total amount of glucamines EP3077493 relates to compositions containing: at least one N-alkyl-N-acyl glucamine; at least one fatty acid and/or soap; at least one acyl isethionate; sodium isethionate; and water, with more than 20 weight percent, preferably more than 70 weight percent of the N-alkyl-N-acyl glucamines containing at least one C12- and/or C14- and/or C16- and/or C18-acyl group, and such compositions being useful as soap bars. EP2855650 relates to a clear composition which contains at least one anionic surfactant, a betaine surfactant, an N-methyl-N-acylglucamine, a triglyceride oil, a solvent and optionally an additive, a method for producing such compositions, and the use of such compositions for the treatment or care of skin or hair, or for use as a shampoo, face cleaner, liquid cleaner or shower gel. EP2855651 relates to a composition which contains at least one anionic surfactant, a betaine surfactant, a mixture of N-methyl-N-acylglucamines, the acyl groups of which correspond to those of natural coconut oil and/or palm kernel oil, a glycerol derivative, a solvent and optionally one or more additives, as well as to a method for producing the composition, and the use of the composition for the treatment or care of skin or hair, for example as a shampoo, face cleaner, liquid cleaner or shower gel. EP2855649 relates to a surfactant concentrate which contains at least one anionic surfactant, an N-methyl-N-acylglucamine, a solvent and optionally one or more additives, as well as to a method for producing the surfactant concentrate, and a method for producing cosmetic, dermatological or pharmaceutical compositions. EP2866895 relates to a surfactant solution containing: a mixture of N-methyl-N-oleylglucamine, N-methyl-N—C12-C14-acylglucamines, other N-methyl-N-acylglucamines; one or more alcohols; water; and additives. EP2855647 relates to a composition which contains one or more N-methyl-N-acylglucamines; at least 80 wt. % of the N-methyl-N-acylglucamines having a saturated or unsaturated C16-, C17- and/or C18-acyl group; one or more fatty alcohols; one or more cationic surfactants; optionally other additives; and water, the composition being suitable for producing cosmetic, dermatological and pharmaceutical emulsions, especially for use in hair care products. EP2854951 relates to a composition which contains at least one N-acyl-amino acid surfactant, a betaine surfactant, an N-methyl-N-acylglucamine, said N-methyl-N-acylglucamine having a C16-C20-acyl group, and further contains a solvent, as well as to a method for producing the composition, and the use of the composition for the treatment or care of skin or hair, or for use as a shampoo, face cleaner, liquid cleaner or shower gel. EP3013429 relates to certain N-alkyl-N-acylglucamines suitable as a component in skin-cleaning agents and hand dishwashing agents, which comprise an aqueous surfactant system with at least one anionic surfactant. EP3114255 relates to a composition comprising at least one N-methyl-N-acylglucamine having a linear or branched, saturated or unsaturated hydrocarbon chain with 7 to 21 carbon atoms, one or more organic acids, having a linear or branched alkyl group or a linear or branched mono- or poly-unsaturated alkenyl group with 5 to 29 carbon atoms, and one or more alkanolamines, with at least one having a hydroxyalkyl group or a hydroxyether group. EP2854751 relates to the use of N-methyl-N—C8-C14-acylglucamines as solubilizers in cosmetic preparations, and to clear lotions for the preparation of wet wipes, the lotions comprising the N-methyl-N—C8-C14-acylglucamines, one or more water-insoluble or only partially water-soluble anti-microbial agents, one or more oils, water, surfactants, and optionally additional auxiliaries and additives. EP3013427 relates to N-alkyl-N-acylglucamines which exhibit in hair-washing agents comprising an aqueous surfactant system with at least one anionic surfactant, a hair-conditioning effect. WO 96/28458 relates to surfactant compositions of use to treat Gram negative bacteria, Gram positive sporeforming bacteria, filamentous fungi or yeasts, which contain a sugar amine WO 99/19432 relates to the use of 0.01-15 wt. % of an alkoxylated aliphatic amine with 8-20 carbon atoms and 1-8 units of alkoxylation to improve the antimicrobial effectiveness of an acidic, antimicrobial composition comprising 0.01-15 wt. % of sulphamic acid.

SUMMARY OF THE INVENTION

The present invention relates to an antimicrobial hard surface cleaning composition comprising: an antimicrobial agent; and an amine surfactant selected from amine of formula I:

R1-N—(R2)(CH2CHOH(CH2O)*n*R3) formula I wherein R1 and R2 are independently selected from hydrogen, cyclic or acyclic, linear or branched C1 to C10 alkyl, C1 to C10 hydroxyalkyl, polyhydroxyhydrocarbyl and polyalkoxy of formula (R4-O)xH with R4 being C1-C4 and x is from 1 to 15; n is 0 or 1, preferably 1; and R3 is a C6 to C30 hydrocarbyl.

The present invention further relates to the use of the amine for improving the antimicrobial efficacy of antimicrobial compositions, as well as a method for using such compositions.

DETAILED DESCRIPTION OF THE INVENTION

Hard surface cleaning compositions of the present invention, comprising an antimicrobial agent, an amine of formula: R1-N—(R2)(CH2CHOH(CH2O)nR3), wherein R1 and R2 are independently selected from hydrogen, cyclic or acyclic, linear or branched C1 to C10 alkyl, C1 to C10 hydroxyalkyl, polyhydroxyhydrocarbyl and polyalkoxy of formula (R4-O)xH with R4 being C1-C4 and x is from 1 to 15; n is 0 or 1, preferably 1; and R3 is a C6 to C30 hydrocarbyl, results in antimicrobial compositions having improved antimicrobial efficacy and improved shine.

As defined herein, "essentially free of" a component means that no amount of that component is deliberately incorporated into the respective premix, or composition. Preferably, "essentially free of" a component means that no amount of that component is present in the respective premix, or composition.

As defined herein, "stable" means that no visible phase separation is observed for a premix kept at 25° C. for a period of at least two weeks, or at least four weeks, or greater than a month or greater than four months.

All percentages, ratios and proportions used herein are by weight percent of the composition, unless otherwise specified. All average values are calculated "by weight" of the composition, unless otherwise expressly indicated. All ratios are calculated as a weight/weight level, unless otherwise specified.

All measurements are performed at 25° C. unless otherwise specified.

Unless otherwise noted, all component or composition levels are in reference to the active portion of that component or composition, and are exclusive of impurities, for example, residual solvents or by-products, which may be present in commercially available sources of such components or compositions.

Antimicrobial Hard Surface Cleaning Compositions:

By "hard surface cleaning composition", it is meant herein a composition for cleaning hard surfaces found in households, especially domestic households. Surfaces to be cleaned include kitchens and bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, steel, kitchen work surfaces, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments. The hard surface cleaning composition is preferably a liquid hard surface cleaning composition.

In a preferred embodiment, the liquid compositions herein are aqueous compositions, comprising at least 10% by weight of water. Therefore, they may comprise from 30% to 99.5% by weight of the total composition of water, preferably from 50% to 98% and more preferably from 80% to 97%.

The compositions of the present invention preferably can be non-thickened, or water like, having a viscosity of from 1 mPa·s to 20 Pa·s, or can be thickened, having a viscosity of from 50 Pa·s to 1200 Pa·s, more preferably 100 Pa·s to 800 Pa·s, most preferably 200 Pa·s to 600 Pa·s when measured at 20° C. with a AD1000 Advanced Rheometer from Atlas® shear rate 10 $s^{-1}$ with a coned spindle of 40 mm with a cone angle 2° and a truncation of ±60 μm.

For improved cleaning, especially greasy soil and particulate greasy soil cleaning performance, the composition pH is preferably greater than 7.0, more preferably greater than 9.5. For improved antibacterial efficacy, in addition to improved cleaning, the pH is still more preferably greater than 10, most preferably greater than 11. For improved surface safety, the pH is preferably less than 13, more preferably less than 12, most preferably less than 11.5. Accordingly, the compositions herein may further comprise an acid or base to adjust pH as appropriate.

A suitable acid for use herein is an organic and/or an inorganic acid. A preferred organic acid for use herein has a pKa of less than 6. A suitable organic acid is selected from the group consisting of: citric acid, lactic acid, glycolic acid, succinic acid, glutaric acid and adipic acid and mixtures thereof. A suitable inorganic acid can be selected from the group consisting of: hydrochloric acid, sulphuric acid, phosphoric acid and mixtures thereof.

A typical level of such acids, when present, is from 0.001% to 5.0% by weight of the total composition, preferably from 0.002% to 3.0% and more preferably from 0.005% to 1.5%.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, $K_2CO_3$, $Na_2CO_3$ and alkanolamines (such as monoethanolamine, triethanolamine, aminomethylpropanol, and mixtures thereof), nitrogenous buffers, and mixtures thereof. Suitable nitrogenous buffers include: ammonium or alkaline earth carbamates, guanidine derivatives, ammonium carbonate, ammonium bicarbonate, diammonium carbonate, ammonium hydroxide, ammonia (which forms ammonium hydroxide in situ when added to water) and mixtures thereof.

Typical levels of such bases, when present, are from 0.01% to 5.0% by weight of the total composition, preferably from 0.05% to 3.0% and more preferably from 0.1% to 2.0%.

The total amount of surfactant is preferably from 0.2% to 20%, more preferably from 0.3% to 15 and most preferably from 0.5% to 12% by weight of the composition.

Cationic Antimicrobial Agent:

Suitable antimicrobial agents are cationic antimicrobial agents, such as quaternary ammonium compounds. Preferred quaternary ammonium compounds are those of the formula:

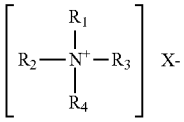

wherein at least one of $R_1$, $R_2$, $R_3$ and $R_4$ is a hydrophobic, aliphatic, aryl aliphatic or aliphatic aryl radical of from 6 to 26 carbon atoms, and the entire cation portion of the molecule has a molecular weight of at least 165. The hydrophobic radical-s may be long-chain alkyl, long-chain alkoxy aryl, long-chain alkyl aryl, halogen-substituted long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ester linkages. The radical X may be any salt-forming anionic radical, and preferably aids in the solubilization of the quaternary ammonium germicide in water. X can be a halide, for example a chloride, bromide or iodide, or X can be a methosulfate counterion, or X can be a carbonate ion.

Exemplary quaternary ammonium compounds include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium compounds include those in which the molecule contains either amide or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

More preferred quaternary ammonium compounds used in the compositions of the invention include those of the structural formula:

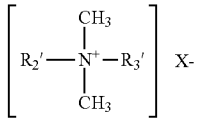

wherein $R_2'$ and $R_3'$ may be the same or different and are selected from C8-C12 alkyl, or $R_2'$ is C12-C16 alkyl, C8-C18 alkylethoxy, C8-C18 alkylphenolethoxy and $R_3'$ is benzyl, and X is a halide, for example a chloride, bromide or iodide, or X is a methosulfate counterion. The alkyl groups recited in $R_2'$ and $R_3'$ may be linear or branched, but are preferably substantially linear, or fully linear.

Particularly useful quaternary germicides include compositions presently commercially available under the tradenames BARDAC, BARQUAT, BTC, and HYAMINE. These quaternary ammonium compounds are usually provided in a solvent, such as a C2 to C6 alcohol (such as ethanol, n-propanol, isopropanol, n-butanol, sec-butanol, and the like), glycols such as ethylene glycol, or in mixtures containing water, such alcohols, and such glycols. Particularly preferred is didecyl dimethyl ammonium chloride, such as supplied by Lonza under tradenames such as: Bardac 2250™, Bardac 2270™, Bardac 2270E™, Bardac 2280™, and/or a blend of alkyl, preferably C12-C18, dimethyl benzyl ammonium chloride and alkyl, preferably C12-C18, dimethyl ethylbenzyl ammonium chloride, such as supplied by Lonza under the brand names: Barquat 4280Z™. In preferred embodiments, the alkyl dimethyl benzyl ammonium chloride and alkyl dimethyl ethylbenzyl ammonium chloride are present in a ratio of from 20:80 to 80:20, or 40:60 to 60:40, with a ratio of 50:50 being the most preferred.

Other suitable, but less preferred, antimicrobial agents include germicidal amines, particularly germicidal triamines such as LONZA-BAC 12, (ex. Lonza, Inc., Fairlawn, N.J. and/or from Stepan Co., Northfield Ill., as well as other sources).

In the cleaning compositions according to the invention, the antimicrobial agent, preferably quaternary ammonium compound, is required to be present in amounts which are effective in exhibiting satisfactory germicidal activity against selected bacteria sought to be treated by the cleaning compositions. Such efficacy may be achieved against less resistant bacterial strains with only minor amounts of the quaternary ammonium compounds being present, while more resistant strains of bacteria require greater amounts of the quaternary ammonium compounds in order to destroy these more resistant strains.

The antimicrobial agent need only be present in germicidally effective amounts, which is as little as 0.001 wt % to less than 2% by weight of the composition. In more preferred compositions, the hard surface cleaning composition comprises the antimicrobial agent at a level of from 0.005 wt % to 1.8 wt %, or from 0.008% to 0.9%, or from 0.01% to 0.5%, or from 0.05% to 0.20% by weight of the composition. Since the amines of use in the compositions of the present invention improve the efficacy of the antimicrobial agent, less antimicrobial agent is required in order to provide the desired antimicrobial efficacy. Since the presence of the antimicrobial agent on the treated surface increases surface dullness, the amines of use in the compositions of the present invention result in compositions providing improved shine, while maintaining or even improving antimicrobial efficacy.

A germicidally effective amount of the antimicrobial agent typically results in at least a log 4, preferably at least a log 5 reduction of *Staphylococcus aureus*, using the method of EN1276 (Chemical Disinfectants Bactericidal Activity Testing), in 5 minutes.

Amine

The compositions of the invention comprise an amine surfactant selected from amine compounds according to formula (I):

R1-N—(R2)(CH2CHOH(CH2O)*n*R3) formula (I)

wherein

R1 and R2 are independently selected from hydrogen, cyclic or acyclic, linear or branched C1 to C10 alkyl, C1 to C10 hydroxyalkyl, polyhydroxyhydrocarbyl and polyalkoxy having the formula (R4-O)xH with R4 being C1-C4 and x is froml to 15, preferably x is from 1 to 5, more preferably x is 1;

n is 0 or 1, preferably 1; and

R3 is a C6 to C30 hydrocarbyl, preferably C6 to C30 alkyl, hydroxyalkyl, alkoxyalkyl, cycloalkyl, aralkyl or alkenyl.

A "polyhydroxyhydrocarbyl" is a hydrocarbyl with two or more hydroxyl (—OH) groups. A "hydrocarbyl" is a univalent group formed by removing a hydrogen atom from a hydrocarbon, e.g. ethyl, phenyl.

When R1 is a polyhydroxyhydrocarbyl, R1 is an acyclic or cyclic polyhydroxyhydrocarbyl, preferably a linear polyhydroxyhydrocarbyl. Preferably R1 is a linear C3 to C8 chain with at least two hydroxyl groups, preferably a C4 to C7 chain with at least three hydroxyl groups directly bonded to the carbon atoms of the chain. R1 can include substituents, in particular, alkoxy groups e.g. by etherification of further hydroxyl groups or further polyhydroxyhydrocarbyl, e.g. polyhydroxy alkyl, group(s). R1 preferably includes at least three free hydroxyl groups including such hydroxyl groups on substituents of the basic carbon chain. Alternatively R1 can be selected from ring structures comprising an internal ether link, the ring comprising at least two or more hydroxyl groups, most preferably the hydroxyl groups are on a carbon atom not connected to the nitrogen in Formula (I). R1 can be an open chain tetratol, pentitol, hexitol or heptitol group or an anhydro e.g. cycloether anhydro derivative of such a group.

R1 can be a polyhydroxyhydrocarbyl derived from a sugar, preferably a sugar selected from the group consisting of: monosaccharide, disaccharide, or trisacchaside, though a monosaccharide is preferred. For instance, R1 can be the residue of, or a residue derived from a sugar, particularly a monosaccharide such as glucose, xylose, fructose or sorbitol; a disaccharide such as maltose or sucrose; or a higher oligosaccharide. While monosaccharides are preferred, disaccharides and trisaccharides can also be present, typically at the ratios present in the sugar from which the polyhydroxyhydrocarbyl is derived. Preferably, R1 is derived from a sugar of the group consisting of glucose, xylose, maltose and mixtures thereof.

Preferred R1 groups are derived from glycoses and are of the formula:

—CH2-(CHOH)4-CH2OH formula II, for instance, corresponding to residues from monosaccharides such as glucose, mannose or galactose, preferably glucose. The aldehyde of the monosaccharide is typically eliminated during the reaction to bind the monosaccharide to the amine of formula I. It is specially preferred when R1 is derived from glucose. In this case the group —NR1 is of the formula:

—N—CH2(CHOH)4CH2OH formula III and the group is conveniently called a glycamine group. Most preferably the group R1 will be derived from glucose and the corresponding amines may be called glucamines (as they will usually be made from glucose). The group R1 may comprise, one, two or more glucose units, and the resulting glucamine may be a mixture of monoglucamine (R1 comprises one glucose unit), diglucamine (R1 comprises two glucose units) and triglucamine (R1 comprises three glucose units).

When R1 is a C1 to C10 alkyl, it is preferably an alkyl comprising from 1 to 5, more preferably from 1 to 4, even more preferably from 1 to 2 carbon atoms. Most preferably when R1 is not a polyhydroxyhydrocarbyl, it is hydrogen or methyl.

Most preferably R1 is a polyhydroxyhydrocarbyl.

R2 is preferably selected from the group consisting of hydrogen and C1 to C10 alkyl, particularly when R1 is a polyhydroxyhydrocarbyl. R2 is preferably hydrogen or an alkyl group comprising from 1 to 5, more preferably from 1 to 4 and even more preferably from 1 to 2 carbon atoms. Most preferably R2 is hydrogen or methyl.

When R1 is not a polyhydroxyhydrocarbyl, R1 and R2 are preferably independently selected from hydrogen or an alkyl group comprising from 1 to 5 preferably from 1 to 4 and even more preferably from 1 to 2 carbon atoms. Most preferably R1 and R2 are independently selected from hydrogen or methyl.

R3 is a hydrocarbyl, preferably selected from C6 to C30 alkyl, hydroxyalkyl, alkoxyalkyl, cycloalkyl, aralkyl or alkenyl groups, preferably the alkyl group comprises from 6 to 30, preferably from 7 to 20, more preferably from 8 to 15, even more preferably from 8 to 12 and most preferably from 8 to 10 carbon atoms. The alkyl group can be linear or branched, preferably C1 to C4 branching, more preferably C1 to C3 branching on the 2- or 3-position, preferably 2-position. R3 can also be a substituted alkyl group e.g. a hydroxy or alkoxy substituted alkyl group, particularly a C6 to C30 alkyl group which is hydroxy substituted. The additional hydroxyl group or oxygen atom may provide a modest increase in water solubility. R3 can also be an aralkyl group, particularly a C7 to C12 aralkyl group, such as a benzyl group. R3 is preferably selected from the group consisting of: C6 to C10 alkyl and mixtures thereof, preferably R3 is selected from the group consisting of hexyl, octyl, decyl, and mixtures thereof, more preferably R3 is decyl, most preferably R3 is 2-propylheptyl. Antimicrobial hard surface cleaning compositions, wherein R3 is decyl, particularly a branched decyl such as 2-propylheptyl, have been found to be particularly effective as antimicrobial compositions, even at more neutral pH, such as from 7.0 to 10.0, or from 7.0 to 9.0, or even from 7.0 to 8.0.

The amine surfactant selected from amine compounds according to formula (I) can have the formula wherein:

R1 is a polyhydroxyhydrocarbyl which is preferably derived from a monosaccharide, more preferably glucose, and has the formula:

—CH2(CHOH)4CH2OH formula II;

R2 is hydrogen or methyl; and

R3 is selected from the group consisting of: C6 to C10 alkyl and mixtures thereof, preferably R3 is selected from the group consisting of hexyl, octyl, decyl, and mixtures thereof, more preferably R3 is decyl, most preferably R3 is 2-propylheptyl.

Preferred amines for use herein include those in which n is 1, R1 is glucose as such forming a glucamine compound, R2 is methyl and R3 is hexyl, octyl or decyl.

When R3 is octyl, it is preferably selected from n-octyl, and 2-ethylhexyl. When R3 is decyl, it is preferably selected from n-decyl and 2-propylheptyl.

Other preferred amines for use herein are those in which n is 1, R1 and R2 are methyl and R3 is hexyl, octyl or decyl. When R3 is octyl, it is preferably selected from n-octyl and 2-ethylhexyl. When R3 is decyl, it is preferably selected from n-decyl and 2-propylheptyl.

Mixtures of different amines can have benefits in terms of processing, solubility and performance.

While such amine surfactants can have a net positive charge at certain pH, they are typically referred to as nonionic surfactants. However, at low pH (below the pKa of the surfactant) they can have a net positive charge.

The composition of the present invention comprises from 0.1% to 15% by weight of the composition of the amine of formula I, preferably from 0.1% to 10%, more preferably from 0.15% to 9.5%, most preferably from 0.3% to 9% by weight.

Surfactant

The antimicrobial hard surface cleaning composition can comprise further surfactant, preferably further surfactant selected from the group consisting of: additional nonionic surfactant, anionic surfactant, amphoteric surfactant, zwitterionic surfactant, and mixtures thereof. Additional nonionic surfactant is particularly preferred.

The antimicrobial hard surface cleaning composition preferably comprises additional nonionic surfactant. The additional nonionic surfactant can be selected from the group consisting of: alkoxylated nonionic surfactants, alkyl polyglycosides, alkoxylated block copolymers (such as EO/PO block copolymers), amine oxides, and mixture thereof. Typically, the antimicrobial hard surface cleaning composition may comprise from 0.015 wt % to 22.0 wt % by weight of the total composition of said nonionic surfactant, preferably from 0.06 wt % to 6.0 wt %, more preferably from 0.15 wt % to 3.5 wt %.

The hard surface cleaning composition can comprise from 0.005 wt % to 9.5 wt %, preferably from 0.01 wt % to 2.0 wt %, more preferably from 0.05 wt % to 1.0 wt % of the composition of alkoxylated alcohol, preferably ethoxylated alcohol.

Suitable alkoxylated nonionic surfactants include primary $C_6$-$C_{16}$ alcohol polyglycol ether i.e. ethoxylated alcohols having 6 to 16 carbon atoms in the alkyl moiety and 4 to 30 ethylene oxide (EO) units. Suitable alkoxylated surfactants include C6-C16 polyethylene glycol ethers made from a Guerbet alcohol and alkylene oxides. When referred to for example $C_{9-14}$ it is meant average carbons and alternative reference to for example EO8 is meant average ethylene oxide units.

Suitable alkoxylated nonionic surfactants are according to the formula RO-(A)nH, wherein: R is a $C_6$ to $C_{18}$, preferably a $C_8$ to $C_{16}$, more preferably a $C_8$ to $C_{12}$ alkyl chain, or a $C_6$ to $C_{28}$ alkyl benzene chain; A is an ethoxy or propoxy or butoxy unit, and wherein n is from 1 to 30, preferably from 1 to 15 and, more preferably from 4 to 12 even more preferably from 5 to 10. Preferred R chains for use herein are the $C_8$ to $C_{22}$ alkyl chains. Even more preferred R chains for use herein are the $C_9$ to $C_{12}$ alkyl chains. R can be linear or branched alkyl chain.

Suitable ethoxylated nonionic surfactants for use herein are Dobanol® 91-2.5 (HLB=8.1; R is a mixture of $C_9$ and $C_{11}$ alkyl chains, n is 2.5), Dobanol® 91-10 (HLB=14.2; R is a mixture of $C_9$ to $C_{11}$ alkyl chains, n is 10), Dobanol® 91-12 (HLB=14.5; R is a mixture of $C_9$ to $C_{11}$ alkyl chains, n is 12), Greenbentine DE80 (HLB=13.8, 98 wt % C10 linear alkyl chain, n is 8), Marlipal 10-8 (HLB=13.8, R is a C10 linear alkyl chain, n is 8), Neodol 91-8 (R is a mixture of $C_9$ to $C_{11}$ alkyl chains, n is 8), Lutensol XL 140 (R is 2-propylheptyl alkyl chain and n is 14), Novel® 12-23 (HLB=16.9; R is C12 and n is 23), Lialethl® 11-5 (R is a C11 alkyl chain, n is 5), Isalchem® 11-5 (R is a mixture of linear and branched C11 alkyl chain, n is 5), Lialethl® 11-21 (R is a mixture of linear and branched $C_{11}$ alkyl chain, n is 21), Isalchem® 11-21 (R is a $C_{11}$ branched alkyl chain, n is 21), Empilan® KBE21 (R is a mixture of $C_{12}$ and $C_{14}$ alkyl chains, n is 21) or mixtures thereof. Preferred herein are Dobanol® 91-5, Neodol® 11-5, Neodol® 91-8, Lutensol® XL140; Novel 12-23, Lialethl® 11-21 Lialethl® 11-5 Isalchem® 11-5 Isalchem® 11-21 Dobanol® 91-8, or Dobanol® 91-10, or Dobanol® 91-12, or mixtures thereof. These Dobanol®/Neodol® surfactants are commercially available from SHELL. These Lutensol® surfactants are commercially available from BASF and these Novel® surfactants are available from Sasol.

Suitable chemical processes for preparing the alkoxylated nonionic surfactants for use herein include condensation of corresponding alcohols with alkylene oxide, in the desired proportions. Such processes are well known to the person skilled in the art and have been extensively described in the art, including the OXO process and various derivatives thereof. Suitable alkoxylated fatty alcohol nonionic surfactants, produced using the OXO process, have been marketed under the tradename NEODOL® by the Shell Chemical Company. Alternatively, suitable alkoxylated nonionic surfactants can be prepared by other processes such as the Ziegler process, in addition to derivatives of the OXO or Ziegler processes.

Preferably, said alkoxylated nonionic surfactant is selected from the group consisting of alkoxylated nonionic surfactants and mixtures thereof. More preferably, said alkoxylated nonionic surfactant is a $C_{9-11}$ EO5 alkylethoxylate, $C_{12-14}$ EO5 alkylethoxylate, a $C_{11}$ EO5 alkylethoxylate, $C_{12-14}$ EO21 alkylethoxylate, $C_{9-11}$ EO8 alkylethoxylate, a 2-propylheptyl EO14 alkylalkoxylate, C12 EO23 alkylethoxylate, or a mixture thereof. Most preferably, said alkoxylated nonionic surfactant is a $C_{11}$ EO5 alkylethoxylate, a $C_{9-11}$ EO8 alkylethoxylate, a $C_{10}$ EO8 alkylethoxylate, a 2-propylheptyl EO14 alkylalkoxylate, a C12 EO23 alkylethoxylate and mixtures thereof. Suitable $C_{10}$ EO8 alkylethoxylate include Marlipal® 10/8 supplied by Sasol, and Greenbentin® DE/080; suitable 2-propylheptyl EO14 alkylalkoxylate include Lutensol XL140 supplied by BASF; suitable C12 EO23 alkylethoxylate include Novel® 12-23 supplied by Sasol; suitable $C_{9-11}$ EO8 alkylethoxylate include Neodol 91-8 supplied by the Shell Chemical Company.

Alkyl polyglycosides are biodegradable nonionic surfactants which are well known in the art, and can also be used in the compositions of the present invention. Suitable alkyl polyglycosides can have the general formula $C_nH_{2n+1}O(C_6H_{10}O_5)_xH$ wherein n is preferably from 9 to 16, more preferably 11 to 14, and x is preferably from 1 to 2, more preferably 1.3 to 1.6.

Suitable amine oxide surfactants include: $R_1R_2R_3NO$ wherein each of $R_1$, $R_2$ and $R_3$ is independently a saturated or unsaturated, substituted or unsubstituted, linear or branched hydrocarbon chain having from 1 to 30 carbon atoms. Preferred amine oxide surfactants are amine oxides having the following formula: $R_1R_2R_3NO$ wherein R1 is an hydrocarbon chain comprising from 1 to 30 carbon atoms, preferably from 6 to 20, more preferably from 8 to 16 and wherein $R_2$ and $R_3$ are independently saturated or unsaturated, substituted or unsubstituted, linear or branched hydrocarbon chains comprising from 1 to 4 carbon atoms, preferably from 1 to 3 carbon atoms, and more preferably are methyl groups. R1 may be a saturated or unsaturated, substituted or unsubstituted linear or branched hydrocarbon chain. Preferably, the antimicrobial hard surface cleaning composition comprises from 0.01 wt % to 9.5 wt %, preferably from 0.01 wt % to 2.0 wt %, more preferably from 0.05 wt % to 1.0 wt % of the composition of amine oxide surfactant. Alternatively, the antimicrobial hard surface cleaning composition can comprise low levels of amine oxide surfactant, such as less than 1.0 wt %, or less than 0.5 wt %, or less than 0.01 wt % of amine oxide surfactant, or even be free of amine oxide surfactant. This is because the amine of use in the compositions of the present invention provide good grease cleaning, while also providing improved shine to the treated surface.

Highly preferred amine oxides are C8 dimethyl amine oxide, C10 dimethyl amine oxide, and $C_{12}$-$C_{14}$ dimethyl amine oxide. C8 dimethyl amine oxide is commercially available under the trade name Genaminox® OC from Clariant, C10 dimethyl amine oxide is commercially available under the trade name Genaminox® K-10 from Clariant, $C_{12}$-$C_{14}$ dimethyl amine oxide is commercially available from Albright & Wilson, and under the trade name Genaminox® LA from Clariant or AROMOX® DMC from AKZO Nobel.

Suitable alkoxylated block copolymers include ethoxylated alkoxylated nonionic surfactants. The ethoxylated alkoxylated nonionic surfactant is preferably selected from the group consisting of: esterified alkyl alkoxylated surfactant; alkyl ethoxy alkoxy alcohol, wherin the alkoxy part of the molecule is preferably propoxy, or butoxy, or propoxy-butoxy; polyoxyalkylene block copolymers, and mixtures thereof.

The preferred ethoxylated alkoxylated nonionic surfactant is an esterified alkyl alkoxylated surfactant of general formula (I):

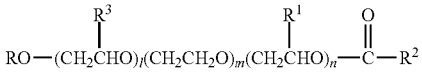

where

R is a branched or unbranched alkyl radical having 8 to 16 carbon atoms, preferably from 10 to 16 and more preferably from 12 to 15;

$R^3$, $R^1$ independently of one another, are hydrogen or a branched or unbranched alkyl radical having 1 to 5 carbon atoms; preferably $R^3$ and $R^1$ are hydrogen $R^2$ is an unbranched alkyl radical having 5 to 17 carbon atoms; preferably from 6 to 14 carbon atoms 1, n independently of one another, are a number from 1 to 5 and m is a number from 8 to 50; and Preferably, the weight average molecular weight of the ethoxylated alkoxylated nonionic surfactant of formula (I) is from 950 to 2300 g/mol, more preferably from 1200 to 1900 g/mol.

R is preferably from 12 to 15, preferably 13 carbon atoms. $R^3$ and IV are preferably hydrogen. 1 is preferably 5. n is preferably 1. m is preferably from 13 to 35, more preferably 15 to 25, most preferably 22. $R^2$ is preferably from 6 to 14 carbon atoms.

The hard surface cleaning composition of the invention provides especially good shine when the esterified alkyl akoxylated surfactant is as follows: R has from 12 to 15, preferably 13 carbon atoms, $R^3$ is hydrogen, $R^1$ is hydrogen, 1 is 5, n is 1, m is from 15 to 25, preferably 22 and $R^2$ has from 6 to 14 carbon atoms and the alcohol ethoxylated has an aliphatic alcohol chain containing from 10 to 14, more preferably 13 carbon atoms and from 5 to 8, more preferably 7 molecules of ethylene oxide.

Another preferred ethoxylated alkoxylated nonionic surfactant is an alkyl ethoxy alkoxy alcohol, preferably wherein the alkoxy part of the molecule is propoxy, or butoxy, or propoxy-butoxy. More preferred alkyl ethoxy alkoxy alcohols are of formula (II):

Formula (II)

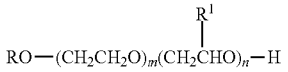

wherein:

R is a branched or unbranched alkyl radical having 8 to 16 carbon atoms;

$R^1$ is a branched or unbranched alkyl radical having 1 to 5 carbon atoms;

n is from 1 to 10; and m is from 6 to 35.

preferably from 12 to 15, preferably 13 carbon atoms. $R^1$ is preferably a branched alkyl radical having from 1 to 2 carbon atoms. n is preferably 1 to 5. m is preferably from 8 to 25. Preferably, the weight average molecular weight of the ethoxylated alkoxylated nonionic surfactant of formula (II) is from 500 to 2000 g/mol, more preferably from 600 to 1700 g/mol, most preferably 800 to 1500 g/mol.

The ethoxylated alkoxylated nonionic surfactant can be a polyoxyalkylene copolymer. The polyoxyalkylene copolymer can be a block-heteric ethoxylated alkoxylated nonionic surfactant, though block-block surfactants are preferred. Suitable polyoxyalkylene block copolymers include ethylene oxide/propylene oxide block polymers, of formula (III):

$(EO)_x(PO)_y(EO)_x$, or $(PO)_x(EO)_y(PO)_x$ wherein EO represents an ethylene oxide unit, PO represents a propylene oxide unit, and x and y are numbers detailing the average number of moles ethylene oxide and propylene oxide in each mole of product. Such materials tend to have higher molecular weights than most non-ionic surfactants, and as such can range between 1000 and 30000 g/mol, although the molecular weight should be above 2200 and preferably below 13000 to be in accordance with the invention. A preferred range for the molecular weight of the polymeric non-ionic surfactant is from 2400 to 11500 Daltons. BASF (Mount Olive, N.J.) manufactures a suitable set of derivatives and markets them under the Pluronic trademarks. Examples of these are Pluronic (trademark) F77, L62 and F88 which have the molecular weight of 6600, 2450 and 11400 g/mol respectively. An especially preferred example of a useful polymeric non-ionic surfactant is Pluronic (trademark) F77.

Other suitable ethoxylated alkoxylated nonionic surfactants are described in Chapter 7 of Surfactant Science and Technology, Third Edition, Wiley Press, ISBN 978-0-471-68024-6.

The ethoxylated alkoxylated nonionic surfactant can provide a wetting effect of from 60 to 200, preferably from 75 to 150. The wetting effect is measured according to EN 1772, using 1 g/l of the ethoxylated alkoxylated nonionic surfactant in distilled water, at 23° C., with 2 g soda/l. Preferred ethoxylated alkoxylated nonionic surfactants include those sold by BASF under the "Plurafac" trademark, such as Plurafac LF 301 (wetting effect of 90 s), LF 401 (wetting effect of 115 s), LF 405 (wetting effect of 100 s), and LF 7319 (wetting effect of 100 s). It is believed that that the combination of an ethoxylated alkoxylated nonionic surfactant having the aforementioned wetting effect, with the additional nonionic surfactant and anionic surfactant, results in beading of the residual wash water on the hard surface, after cleaning, and hence, improved removal of the residual dirt during subsequent wiping. Moreover, the resultant beading results faster drying time and hence less slipperiness. In comparison, non-preferred ethoxylated alkoxylated nonionic surfactants, such as Plurafac LF 300 (wetting effect of 60) results in less shine and longer drying times.

The nonionic surfactant is preferably a low molecular weight nonionic surfactant, having a molecular weight of less than 1200 g/mol, more preferably less than 800, most preferably less than 500 g/mol.

If anionic surfactant is present, it is preferably present at low levels. The anionic surfactant can be selected from the group consisting of: an alkyl sulphate, an alkyl alkoxylated sulphate, a sulphonic acid or sulphonate surfactant, and mixtures thereof. The antimicrobial hard surface cleaning composition can comprise up to 2.0 wt %, preferably up to 1.0 wt %, or up to 0.1 wt % of anionic surfactant. In most preferred embodiments, the composition is essentially free, or free of, of anionic surfactant.

If anionic surfactant is used, alkyl ethoxylated sulphates, especially those with an ethoxylation degree of 1 to 8, preferably 2 to 5, are preferred.

Suitable alkyl sulphates for use herein include water-soluble salts or acids of the formula $ROSO_3M$ wherein R is a $C_6$-$C_{18}$ linear or branched, saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly suitable linear alkyl sulphates include $C_{12-14}$ alkyl sulphate like EMPICOL® 0298/, EMPICOL® 0298/F or EMPICOL® XLB commercially available from Huntsman. By "linear alkyl sulphate" it is meant herein a non-substituted alkyl sulphate wherein the linear alkyl chain comprises from 6 to 16 carbon atoms, preferably from 8 to 14 carbon atoms, and more preferably from 10 to 14 carbon atoms, and wherein this alkyl chain is sulphated at one terminus.

Suitable sulphonated anionic surfactants for use herein are all those commonly known by those skilled in the art. Preferably, the sulphonated anionic surfactants for use herein are selected from the group consisting of: alkyl sulphonates; alkyl aryl sulphonates; naphthalene sulphonates; alkyl alkoxylated sulphonates; and $C_6$-$C_{16}$ alkyl alkoxylated linear or branched diphenyl oxide disulphonates; and mixtures thereof.

Suitable alkyl sulphonates for use herein include water-soluble salts or acids of the formula $RSO_3M$ wherein R is a $C_6$-$C_{18}$ linear or branched, saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$-$C_{18}$ linear or branched saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly suitable linear alkyl sulphonates include $C_{12}$-$C_{16}$ paraffin sulphonate like Hostapur® SAS commercially available from Clariant. Particularly preferred alkyl aryl sulphonates are alkyl benzene sulphonates commercially available under trade name Nansa® available from Huntsman.

By "linear alkyl sulphonate" it is meant herein a non-substituted alkyl sulphonate wherein the alkyl chain comprises from 6 to 18 carbon atoms, preferably from 8 to 16 carbon atoms, and more preferably from 10 to 16 carbon atoms, and wherein this alkyl chain is sulphonated at one terminus.

Suitable alkoxylated sulphonate surfactants for use herein are according to the formula $R(A)mSO_3M$, wherein R is an unsubstituted $C_6$-$C_{18}$ alkyl, hydroxyalkyl or alkyl aryl group, having a linear or branched $C_6$-$C_{18}$ alkyl component, preferably a $C_8$-$C_{16}$ alkyl or hydroxyalkyl, more preferably C12-C16 alkyl or hydroxyalkyl, and A is an ethoxy or propoxy or butoxy unit, and m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulphonates, alkyl butoxylated sulphonates as well as alkyl propoxylated sulphonates are contemplated herein. pecific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like.

Exemplary surfactants are $C_{12}$-$C_{18}$ alkyl polyethoxylate (1.0) sulphonate ($C_{12}$-$C_{18}E(1.0)SM$), $C_{12}$-$C_{18}$ alkyl polyethoxylate (2.25) sulphonate ($C_{12}$-$C_{18}E(2.25)SM$), $C_{12}$-$C_{18}$ alkyl polyethoxylate (3.0) sulphonate ($C_{12}$-$C_{18}E(3.0)SM$), and $C_{12}$-$C_{18}$ alkyl polyethoxylate (4.0) sulphonate ($C_{12}$-$C_{18}E(4.0)SM$), wherein M is conveniently selected from sodium and potassium. Particularly suitable alkoxylated sulphonates include alkyl aryl polyether sulphonates like Triton X-200® commercially available from Dow Chemical.

Preferably said sulphated or sulphonated anionic surfactant for use herein is selected from the group consisting of alkyl sulphates (AS) preferably $C_{12}$, $C_{13}$, $C_{14}$ and $C_{15}$ AS, sodium linear alkyl sulphonate (NaLAS), sodium paraffin sulphonate $NaPC_{12-16}S$, and mixtures thereof. Most preferably sulphated or sulphonated anionic surfactant for use herein is selected from the group consisting of alkyl sulphates (AS) preferably, $C_{12}$, $C_{13}$, $C_{14}$ and $C_{15}$ AS, sodium linear alkyl sulphonate (NaLAS), sodium paraffin sulphonate $NaPC_{12-16}S$ and mixtures thereof.

The hard surface cleaning composition may comprise up to 15% by weight of an additional surfactant, preferably selected from: an amphoteric, zwitterionic, and mixtures thereof. More preferably, the hard surface cleaning composition can comprise from 0.5% to 5%, or from 0.5% to 3%, or from 0.5% to 2% by weight of the additional surfactant.

Suitable zwitterionic surfactants typically contain both cationic and anionic groups in substantially equivalent proportions so as to be electrically neutral at the pH of use, and are well known in the art. Some common examples of zwitterionic surfactants (such as betaine/sulphobetaine surfacants) are described in U.S. Pat. Nos. 2,082,275, 2,702,279 and 2,255,082.

Amphoteric surfactants can be either cationic or anionic depending upon the pH of the composition. Suitable amphoteric surfactants include dodecylbeta-alanine, N-alkyltaurines such as the one prepared by reacting dodecylamine with sodium isethionate, as taught in U.S. Pat. No. 2,658,072, N-higher alkylaspartic acids such as those taught in U.S. Pat. No. 2,438,091, and the products sold under the trade name "Miranol", as described in U.S. Pat. No. 2,528,378. Other suitable additional surfactants can be found in McCutcheon's Detergents and Emulsifers, North American Ed. 1980.

Optional Ingredients:

Chelating Agent:

The antimicrobial hard surface cleaning composition can comprise a chelating agent or crystal growth inhibitor. Suitable chelating agents, in combination with the surfactant system, improve the shine benefit. Chelating agent can be incorporated into the compositions in amounts ranging from 0.05% to 5.0% by weight of the total composition, preferably from 0.1% to 3.0%, more preferably from 0.2% to 2.0% and most preferably from 0.2% to 0.4%.

Suitable phosphonate chelating agents include ethylene diamine tetra methylene phosphonates, and diethylene triamine penta methylene phosphonates (DTPMP), and can be present either in their acid form or as salts.

A preferred biodegradable chelating agent for use herein is ethylene diamine N,N'-disuccinic acid, or alkali metal, or alkaline earth, ammonium or substitutes ammonium salts thereof or mixtures thereof, for instance, as described in U.S. Pat. No. 4,704,233. A more preferred biodegradable chelating agent is L-glutamic acid N,N-diacetic acid (GLDA) commercially available under tradename Dissolvine 47S from Akzo Nobel.

Suitable amino carboxylates include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraaminehexa-acetates, ethanoldiglycines, and methyl glycine diacetic acid (MGDA), both in their acid form, or in their alkali metal, ammonium, and substituted ammonium salt forms. Particularly suitable amino carboxylate to be used herein is propylene diamine tetracetic acid (PDTA) which is, for instance, commercially available from BASF under the trade name Trilon FSO and methyl glycine di-acetic acid (MGDA). Most preferred aminocarboxylate used herein is diethylene triamine pentaacetate (DTPA) from BASF. Further carboxylate chelating agents for use herein include salicylic acid, aspartic acid, glutamic acid, glycine, malonic acid or mixtures thereof.

Additional Polymers:

The antimicrobial hard surface cleaning composition may comprise an additional polymer. It has been found that the presence of a specific polymer as described herein, when present, allows further improving the grease removal performance of the liquid composition due to the specific sudsing/foaming characteristics they provide to the composition. Suitable polymers for use herein are disclosed in co-pending EP patent application EP2272942 (09164872.5) and granted European patent EP2025743 (07113156.9).

The polymer can be selected from the group consisting of: a vinylpyrrolidone homopolymer (PVP); a polyethyleneglycol dimethylether (DM-PEG); a vinylpyrrolidone/dialkylaminoalkyl acrylate or methacrylate copolymers; a polystyrenesulphonate polymer (PSS); a poly vinyl pyridine-N-oxide (PVNO); a polyvinylpyrrolidone/vinylimidazole copolymer (PVP-VI); a polyvinylpyrrolidone/polyacrylic acid copolymer (PVP-AA); a polyvinylpyrrolidone/vinylacetate copolymer (PVP-VA); a polyacrylic polymer or polyacrylicmaleic copolymer; and a polyacrylic or polyacrylic maleic phosphono end group copolymer; and mixtures thereof.

Typically, the antimicrobial hard surface cleaning composition may comprise from 0.005% to 5.0% by weight of the total composition of said polymer, preferably from 0.10% to 4.0%, more preferably from 0.1% to 3.0% and most preferably from 0.20% to 1.0%.

Fatty acids are less preferred since they can affect the performance of many antimicrobial agents. If present, the fatty acid is preferably present at low levels of less than 0.25 wt % and can include the alkali salts of a $C_8$-$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms. Suitable fatty acids may be selected from caprylic acid, capric acid, lauric acid, myristic acid, palmitic acid, stearic acid, oleic acid, and mixtures of fatty acids suitably hardened, derived from natural sources such as plant or animal esters (e.g., palm oil, olive oil, coconut oil, soybean oil, castor oil, tallow, ground oil, whale and fish oils and/or babassu oil. For example coconut fatty acid is commercially available from KLK OLEA under the name PALMERAB1211.

Solvent:

The liquid compositions of the present invention may comprise a solvent or mixtures thereof as a preferred optional ingredient.

Suitable solvent is selected from the group consisting of: ethers and diethers having from 3 to 14 carbon atoms; glycols (such as propylene glycol), or alkoxylated glycols; alkoxylated aromatic alcohols; aromatic alcohols; alkoxylated aliphatic alcohols; aliphatic alcohols; $C_8$-$C_{14}$ alkyl and cycloalkyl hydrocarbons and halohydrocarbons; $C_6$-$C_{16}$ glycol ethers; terpenes; and mixtures thereof. Ethers such as n-butoxypropanol and glycol ethers such as dipropylene glycol n-butyl ether are particularly preferred.

When present, the solvent can be present at a level of from 0.1 wt % to 10 wt %, or 0.2 wt % to 5 wt %, or 0.5 wt % to 3 wt %.

Solfactants:

The liquid composition may comprise solfactants, i.e. compounds having efficacy as both solvents and surfactants. Examples of solfactants include but are not limited to glycerin ether ethoxylate solfactants of the formula:

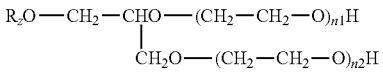

wherein $R_Z$ is a linear or branched alkyl group having 1 to 30 carbon atoms, wherein $n_1$ and/or $n_2$ is 1 to 20.

Suitable solfactants are described in US 2014/0005273 A1.

Thickener:

The antimicrobial hard surface cleaning composition according to the present invention can further comprise a thickener. A thickener provides a higher viscosity cleaning composition which gives longer contact time and therefore more time for the composition to penetrate into the greasy soil and/or particulated greasy soil to improve cleaning effectiveness. A thickener can also improve product stability.

Suitable thickeners are herein include polyacrylate based polymers, preferably hydrophobically modified polyacrylate polymers; amide polymers; hydroxyl ethyl cellulose, preferably hydrophobically modified hydroxyl ethyl cellulose, xanthan gum, hydrogenated castor oil (HCO) and mixtures thereof.

Preferred thickeners are polyacrylate based polymers, preferably hydrophobically modified polyacrylate polymers. Preferably a water soluble copolymer based on main monomers acrylic acid, acrylic acid esters, vinyl acetate, methacrylic acid, acrylonitrile and mixtures thereof, more preferably copolymer is based on methacrylic acid and acrylic acid esters having appearance of milky, low viscous dispersion. Most preferred hydrologically modified polyacrylate polymer is Rheovis® AT 120, which is commercially available from BASF.

Other suitable thickeners are hydroxethylcelluloses (HM-HEC) preferably hydrophobically modified hydroxyethylcellulose.

Suitable hydroxethylcelluloses (HM-HEC) are commercially available from Aqualon/Hercules under the product name Polysurf 76® and W301 from 3V Sigma.

Xanthan gum is one suitable thickener used herein. Xanthan gum is a polysaccharide commonly used rheoligy modifier and stabilizer. Xanthan gum is produced by fermentation of glucose or sucroce by the *Xanthomonas campestris* bacterium.

Suitable Xanthan gum is commercially available under trade anem Kelzan T® from CP Kelco.

Hydrogenated castor oil is one suitable thickener used herein. Suitable hydrogenated castor oil is available under trade name THIXCIN R from Elementis.

Other suitable thickeners are amide polymers. Suitable amide polymers are polymerized fatty acid-based polyamides, as described in US20030162938A1. Suitable amide polymers are commercially available under the trade name of CrystaSense™ such as CrystaSense™ HP4, CrystaSense™ HP5 and CrystaSense™ MP from Croda.

The most preferred thickener used herein are hydrophobic alkali swellable emulsion (HASE) thickeners. As such, the antimicrobial hard surface cleaning composition preferably comprises from 0.1% to 10.0% by weight of the total composition of said thickener, preferably from 0.2% to 5.0%, more preferably from 0.2% to 2.5% and most preferably from 0.2% to 2.0%.

An increased viscosity, especially low shear viscosity, provides longer contact time, especially on inclined surfaces, and therefore improved penetration of greasy soil and/or particulated greasy soil. As a result, an increased viscosity improves cleaning and antimicrobial efficacy, especially when applied neat to the surface to be treated. Moreover, a high low shear viscosity improves the phase stability of the liquid cleaning composition, and especially improves the stability of the copolymer in compositions in the antimicrobial hard surface cleaning composition. Hence, preferably, the antimicrobial hard surface cleaning composition, comprising a thickener, has a viscosity of from 50 Pa·s to 1200 Pa·s, more preferably 100 Pa·s to 800 Pa·s, most preferably 200 Pa·s to 600 Pa·s, at 20° C. when measured with a AD1000 Advanced Rheometer from Atlas® shear rate 10 $s^{-1}$ with a coned spindle of 40 mm with a cone angle 2° and a truncation of ±60 μm.

The hydrophobically modified alkali swellable emulsion (HASE) comprises a thickening polymer, the thickening polymer comprising the following monomers:

(a) greater than 10 mol % of a carboxylic acid containing monomer;

(b) less than 90 mol % of an alkyl (meth)acrylate monomer;

(c) 0 to 3 wt %, preferably 0.1 to 2%, more preferably 0.5 to 2% of an associative monomer according to formula (I) or formula (II):

$$R_1—CH=CH—COO—(CH_2CH_2O)_n—R_2 \quad \text{formula (I)}$$

$$R_1—CH=CH—R_3—NH—COO—(CH_2CH_2O)_n—R_2 \quad \text{formula (II)}$$

in which:

(i) $R_1$ is H, C or COOH;

(ii) $R_2$ is a C8-C30 alkyl chain, preferably aliphatic, preferably saturated, preferably linear;

(iii) n is an integer between 2 and 150, preferably between 2 and 50, more preferably between 8 and 30, most preferably between 10 and 26; and (iv) $R_3$ is a C1-12 alkyl chain, which can be linear, branched, aromatic or combinations thereof;

For improved transparency, the carboxylic acid containing monomer is preferably present at a level greater than 20 mol %, more preferably 25 mol %, even more preferably greater than 35 mol % of the thickening polymer. The carboxylic acid containing monomer can be selected from the group consisting of: acrylic acid, methacrylic acid, itaconic acid or maleic acid, and mixtures thereof. For improved thickening, the carboxylic acid containing monomer is preferably present at the level of less than 80 mol %, more preferably less than 75 mol %, even more preferably 65 mol %.

For improved transparency, the alkyl (meth)acrylate monomer is more preferably present at a level of less than 75 mol %, more preferably less than 65 mol % of the thickening polymer. Any suitable alkyl chain can be used, though $C_1$-$C_8$ is preferred. In more preferred embodiments, the alkyl chain is ethyl ($C_2$) or butyl ($C_4$). The alkyl chain can be attached to the (meth)acrylate group by any suitable means, though ester bonds are preferred. For improved thickening the alkyl (meth)acrylate monomer is more preferably present at a level of greater than 10 mol %, more preferably greater than 30 mol %.

The monomers of the thickening polymer sum up to 100 mol %.

The thickening polymer is preferably not crosslinked. The monomers can be randomly distributed or distributed in blocks, though random is preferred for improved thickening.

Compositions which comprise a HASE thickener, in which the thickening polymer comprises greater than 20 mol % of a carboxylic acid containing monomer, less than 80 mol % of an alkyl (meth)acrylate monomer, and 0 to 3 mol %, preferably 0.1 to 2 mol %, more preferably 0.5 mol % to 2 mol % of an associative monomer according to formula (I) or formula (II), and particularly effective at maintaining the antimicrobial effect of the antimicrobial agent.

The thickening polymer preferably has a weight average molecular weight of from 50,000 Da to 2,000,000 Da, more preferably from 100,000 Da to 1,000,000 Da, most preferably from 300,000 Da to 600,000 Da.

Suitable hydrophobically modified alkali swellable emulsions (HASE) are sold under the various brand names by Lubrizol Corporation, Clariant, Akzo Nobel, Coatex, 3V Sigma, SEPPIC, Ashland and BASF. Particularly suited, are Rheovis AT120, Novethix L10 and Novethix HC200 (Lubrizol), Crystasense Sapphire (Clariant), Alcoguard 5800 (Akzo Nobel), Rheosolve 637 and Rheosolve 650 (Coatex), Polygel W30 (3V Sigma), Capige198 (SEPPIC), Jaypol AT4 (Ashland), Salcare SC80 and Luvigel FIT (BASF)."

Other Optional Ingredients:

The antimicrobial hard surface cleaning compositions may comprise a variety of other optional ingredients depending on the technical benefit aimed for and the surface treated. Suitable optional ingredients for use herein include perfume, builders, other polymers, buffers, hydrotropes, colorants, stabilisers, radical scavengers, abrasives, soil suspenders, brighteners, anti-dusting agents, dispersants, dye transfer inhibitors, pigments, silicones and/or dyes.

Method of Cleaning a Surface:

The antimicrobial hard surface cleaning compositions described herein are particularly suited for cleaning surfaces selected from the group consisting of: ceramic tiles, enamel, stainless steel, Inox®, Formica®, vinyl, no-wax vinyl, linoleum, melamine, glass, plastics and plastified wood, and combinations thereof. In particular, the compositions are particularly suited for reducing or removing antimicrobial activity, while leaving surfaces clean, shiny and grease free.

For general cleaning, especially of floors, the preferred method of cleaning hard surfaces comprises the steps of:

a) Optionally diluting an antimicrobial hard surface cleaning composition described herein, and b) applying the diluted composition to a hard surface.

The antimicrobial hard surface cleaning compositions described herein can be used neat or can be diluted with water prior to applying to the surface. In preferred methods, the hard surface cleaning composition is applied neat, more preferably, the hard surface cleaning composition is sprayed onto the hard surface.

The antimicrobial hard surface cleaning composition may be diluted to a level of from 0.3% to 1.5%, or 0.4% to 1.3% by volume, for instance, in the case of concentrated hard surface cleaning compositions. The antimicrobial hard surface cleaning composition may be diluted to a level of from 0.4% to 0.6% by volume, especially where the antimicrobial hard surface cleaning composition has a total surfactant level of greater than or equal to 5% by weight. Where the antimicrobial hard surface cleaning composition has a total surfactant level of less than 5% by weight, the antimicrobial hard surface cleaning composition may be diluted to a level of from 0.7% to 1.4% by volume. In preferred embodiments, the antimicrobial hard surface cleaning composition is diluted with water.

The dilution level is expressed as a percent defined as the fraction of the antimicrobial hard surface cleaning composition, by volume, with respect to the total amount of the diluted composition. For example, a dilution level of 5% by volume is equivalent to 50 ml of the antimicrobial hard surface cleaning composition being diluted to form 1000 ml of diluted composition.

The diluted composition can be applied by any suitable means, including using a mop, sponge, or other suitable implement.

The hard surface may be rinsed, preferably with clean water, in an optional further step, and also as a further step, wiped, such as with a cloth.

Alternatively, and especially for particularly dirty or greasy spots, the antimicrobial hard surface cleaning compositions, can be applied neat to the hard surface. By "neat", it is to be understood that the liquid composition is applied directly onto the surface to be treated without undergoing any significant dilution, i.e., the liquid composition herein is applied onto the hard surface as described herein, either directly or via an implement such as a sponge, or cleaning cloth, or a paper towel, without first diluting the composition. By significant dilution, what is meant is that the composition is diluted by less than 10 wt %, preferably less than 5 wt %, more preferably less than 3 wt %. Such dilutions can arise from the use of damp implements to apply the composition to the hard surface, such as sponges which have been "squeezed" dry.

In another preferred embodiment of the present invention said method of cleaning a hard surface includes the steps of applying, preferably spraying, said liquid composition onto said hard surface, leaving said liquid composition to act onto said surface for a period of time to allow said composition to act, with or without applying mechanical action, and optionally removing said liquid composition, preferably removing said liquid composition by rinsing said hard surface with water and/or wiping said hard surface with an appropriate instrument, e.g., a sponge, a paper or cloth towel and the like. Such compositions are often referred to as "ready-to-use" compositions. In preferred methods, the hard surface is not rinsed after application of the antimicrobial hard surface cleaning composition.

It is believed that the incorporation of the amine surfactant selected from amine of formula I results in a change in the surfactant system, such that more of the antimicrobial agent is available in free, monomeric, form, rather than incorporated into a micellar structure of the surfactant system. As a result, the antimicrobial efficacy of the antimicrobial agent in the antimicrobial composition is improved. Indeed, it has been found that the antimicrobial hard surface cleaning compositions of the present invention exhibit improved antimicrobial efficacy, even for gram negative bacterial, even at more neutral pH such as from 6.0 to 10, preferably from 7.0 to 9.0, more preferably from 7.0 to 8.0. Such compositions are thus particularly suitable for the antimicrobial treatment of hard surfaces.

Methods:

A) pH Measurement:

The pH is measured on the neat composition, at 25° C., using a pH meter with compatible gel-filled pH probe (such as Sartarius PT-10P meter with Toledo probe part number 52 000 100), calibrated according to the instructions manual.

B) Neat Shine Test:

The shine test is done by applying 0.5 mL of the ready-to-use antimicrobial composition diagonally on the surface of clean black glossy ceramic tile (20 cm×30 cm) Immediately after applying the product, the product is spread over the entire surface of the tile by wiping gently with a double folded damp cotton cloth (8 cm×10 cm folded into quarters) by drawing an M-pattern which covers the entire tile, repeat the wiping in the other direction to ensure a homogeneous coverage of the tile (x8 wipes horizontally-back and forth, x10 wipes vertically-up and down, and x8 wipes horizontally-back and forth) and without lifting the cloth. After letting the tiles dry, results are analysed by using the grading scale described below.

Grading in Absolute Scale:

0=as new/no streaks and/or film

1=very slight streaks and/or film

2=slight streaks and/or film

3=slight to moderate streaks and/or film

4=moderate streaks and/or film

5=moderate/heavy streaks and/or film

6=heavy streaks and/or film

Each tile is evaluated by at least 10 panellists.

C) Antibacterial Efficacy (Minimum Biocidal Concentration in Suspension):

The antimicrobial efficacy of the antimicrobial agent in the composition is determined by measuring its Minimum Biocidal Concentration (MBC). The MBC is defined as the lowest absolute concentration of the particular antimicrobial active which provides complete kill (zero bacterial growth). The MBC of the compositions herein is determined against the bacteria, *Staphylococcus aureus* (*S. aureus*—ATCC #6538), a gram positive bacteria, and *Pseudomonas aeruginosa* (*P. aeruginosa*—ATCC #9027), a gram negative bacteria. These microorganisms are representative of natural contaminants in many consumer and industrial applications. The bacteria inoculum is prepared by transferring several colonies from a Tryptone Soy Agar (TSA) plate to a saline solution (0.85% NaCl), the bacteria concentration in this saline solution is determined by measuring the % Transmittance at 425 nm and adjusted by either adding more bacteria or more saline solution until the % Transmittance at 425 nm is between 23-25% which corresponds to a bacteria concentration of $10^8$ CFU/ml.

The antimicrobial agent was added to the hard surface cleaning composition at a level of 1000 ppm, or 600 ppm, or 150 ppm depending on what the Minimum Biocidal Concentration (MBC) is 200 μL of the antimicrobial hard surface cleaning composition was dosed into one well of row A of a 96 well microtiter plate. Each subsequent well (rows B to G) were dosed with 100 μL of the same hard surface cleaning composition, without the addition of the antimicrobial agent. 100 μL of the antimicrobial hard surface cleaning composition was transferred from row A to row B and mixed. 100 μL of the composition was then transferred from row B to row C and mixed, and the process repeated to row G. As such, the concentration of the antimicrobial agent underwent two-fold dilution in adjacent wells, while the concentration of the other actives in the hard surface cleaning composition were constant across all the wells in the same column.

10 μL of the $10^8$ CFU/ml bacteria suspension in saline was added to wells A to F of the microtiter plate with row G kept as a nil bacteria control. The final volume in each well is 110 μL, except for row G which comprised 100 μL of the hard surface cleaning composition and no bacteria suspension. Bacterial inoculation to each column was staggered by 30 seconds to allow for equal incubation times in all columns so that the contact time between the bacteria and the antimicrobial active for all samples was 6 mins. After this contact time, 10 μL of each test solution was transferred to 90 μL of neutraliser solution (Modified Letheen Broth+1.5% Polysorbate 80, supplied by BioMérieux) to stop the antimicrobial action of the antimicrobial active. 2 μL of this solution was plated onto a TSA plate matching the stagger of the inoculation so that all samples are exposed to the neutralizer for the same period of time. The plate is incubated at 32.5° C. for 48 h for *S. aureus* and 24 h for *P. aeruginosa*, since the latter requires shorter incubation times. MBC concentration is taken as the lowest concentration of the antimicrobial active at which no visible colony growth is observed on the TSA plate.

EXAMPLES

Example 1

The following compositions were prepared and the minimum biocidal concentration for didecyl-dimethyl ammonium chloride (Bardac 2250, supplied by Lonza) against *Staphylococcus aureus* (a gram positive bacteria) was evaluated for each composition. Examples A to C are comparative and do not comprise an amine of formula I. Examples 1 to 5 are compositions of the present invention, comprising the amine of formula I.

| | Ex A* wt % | Ex B* wt % | Ex C* wt % | Ex. 1 wt % | Ex. 2 wt % | Ex. 3 wt % | Ex. 4 wt % | Ex.5 wt % |
|---|---|---|---|---|---|---|---|---|
| C9-11alcohol ethoxylate EO8 | — | — | 2.25 | — | 0.1 | — | 2.25 | 0.1 |
| 2-propylheptyl EO14 alkylalkoxylate | — | 0.1 | — | 0.1 | — | — | — | — |
| C12 alcohol ethoxylate EO23 | 0.1 | — | — | — | — | 0.1 | — | — |
| C12-14 dimethyl amine oxide | 0.5 | — | — | — | 0.25 | — | — | — |
| Lauramidopropyl betaine[1] | — | 0.5 | — | — | — | — | — | — |
| Amine 1[2] | — | — | — | — | 0.25 | 0.5 | 0.75 | 0.5 |
| Amine 2[3] | — | — | — | 0.5 | — | — | — | — |
| C10 N-methyl glucamide | — | — | 0.75 | — | — | — | — | — |
| Sodium Carbonate | 0.1 | — | — | — | — | — | — | — |
| Monoethanol amine | 0.9 | — | — | — | — | 0.9 | — | 0.9 |

-continued

| | Ex A* wt % | Ex B* wt % | Ex C* wt % | Ex. 1 wt % | Ex. 2 wt % | Ex. 3 wt % | Ex. 4 wt % | Ex.5 wt % |
|---|---|---|---|---|---|---|---|---|
| pH (adjusted with minor amounts of HCl or NaOH) | 11 | 7 | 7 | 7 | 7 | 11 | 7 | 11 |
| Water and minors | To 100% | To 100% | To 100% | To 100% | To 100% | To 100% | To 100% | To 100% |

*Comparative

[1]Lauramidopropyl betaine (Mackam ® DAB), supplied by Solvay Novecare

[2]Amine of formula I, wherein R1 is CH2 (CHOH)4 CH2OH, R2 is Methyl, and R3 is 2-propylheptyl; The amine of formula I was made by reacting 2-propylheptyl derived alkyl glycydyl ether (2-((2-propylheptyl) oxy)oxirane) with N-methyl glucamine. The 2-propylheptyl derived alkyl glycydil ether is made by adding epichlorohydrin to the 2-propylheptyl alcohol in the presence of a stannic chloride catalyst at 60° C. to yield the crude ether. Water and caustic are added to form the finished ether. The 2-propylheptyl derived alkyl glycydyl ether is then purified by decanting the top layer, drying under nitrogen and filtering. The N-methyl glucamine is added to methanol under stirring to form a suspension, to which is added the 2-propylheptyl derived alkyl glycydil ether, with the mixture stirred at 55° C. for 6-24 hours. The methanol is then evaporated away to yield the amine of formula I (6-((2 -hydroxy-3-((2-propylheptyl)oxy)propyl)(methyl) amino)hexane-1,2,3,4,5-pentaol).

[3]Amine of formula I, wherein R1 is CH2 (CHOH)4 CH2OH, R2 is Methyl, and R3 is n-decyl; The amine was made in the same manner as described above, except that n-decyl alcohol was used instead of 2-propylheptyl.

The resultant minimum biocidal concentration against *Staphylococcus aureus* for didecyl-dimethyl ammonium chloride (Bardac 2250, Lonza) is given below:

| | Ex A* | Ex B* | Ex C* | Ex. 1 | Ex. 2 | Ex. 3 | Ex. 4 | Ex. 5 |
|---|---|---|---|---|---|---|---|---|
| MBC Bardac 2250 (ppm) | 75 | 500 | 300 | <9.4 | <18.8 | <9.4 | <9.4 | <9.4 |

As can be seen from comparing the minimum biocidal concentration of Bardac 2250 for example 1 vs comparative example B, compositions comprising the amine of formula I provide improved antimicrobial efficacy against gram positive bacteria in comparison to compositions comprising betaine surfactant. As can be seen from comparing the minimum biocidal concentration of Bardac 2250 for example 3 vs comparative example A, compositions comprising the amine of formula I provide improved antimicrobial efficacy against gram positive bacteria in comparison to compositions comprising amine oxide surfactant.

As can be seen from comparing the minimum biocidal concentration of Bardac 2250 for example 4 vs comparative example C, compositions comprising the amine of formula I provide improved antimicrobial efficacy in comparison to compositions comprising glucamide surfactant.

Example 2

The following compositions were prepared and the minimum biocidal concentration of didecyl-dimethyl ammonium chloride (Bardac 2250, supplied by Lonza) against *Pseudomonas aeruginosa* (a gram negative bacteria) was evaluated for each composition. Comparative examples D does not comprise an amine of formula I. Examples 6 and 7 are compositions of the present invention, comprising the amine of formula I:

| | Ex D* wt % | Ex. 6 wt % | Ex. 7 wt % |
|---|---|---|---|
| C9-11alcohol ethoxylate EO8 | 0.1 | 0.1 | 0.1 |
| C12-14 dimethyl amine oxide | 0.5 | — | — |
| Amine 1[2] | — | 0.5 | — |
| Amine 2[3] | | | 0.5 |

-continued

| | Ex D* wt % | Ex. 6 wt % | Ex. 7 wt % |
|---|---|---|---|
| pH (adjusted with minor amounts of HCl or NaOH) | 7 | 7 | 7 |
| Water and minors | To 100% | To 100% | To 100% |

*Comparative

[2]Amine of formula I, wherein R1 is CH2(CHOH)4CH2OH, R2 is Methyl, and R3 is 2-propylheptyl

[3]Amine of formula I, wherein R1 is CH2(CHOH)4CH2OH, R2 is Methyl, and R3 is n-decyl The resultant minimum biocidal concentration against *Pseudomonas aeruginosa* for didecyl-dimethyl ammonium chloride (Bardac 2250, Lonza) is given below:

| | Ex D* | Ex. 6 | Ex.7 |
|---|---|---|---|
| MBC Bardac 2250 (ppm) | >300 | <5 | <15.6 |

As can be seen from comparing the minimum biocidal concentration for examples 6 and 7 vs comparative example D, compositions comprising the amine of formula I provide improved antimicrobial efficacy in comparison to compositions comprising C12-C14 amine oxide surfactant at neutral pH, against gram negative bacteria.

Example 3

The following compositions were prepared and evaluated using the neat shine test method. Comparative example F is based on comparative example B, with a didecyl dimethyl ammonium chloride concentration which is 3 times the minimum biocidal concentration against *Staphylococcus aureus* in the composition of example B. Comparative example G is based on comparative example B, with a didecyl dimethyl ammonium chloride concentration equal to the minimum biocidal concentration against *Staphylococcus aureus* in the composition of example B. Comparative example H is based on comparative example C with a didecyl dimethyl ammonium chloride concentration which is five times that of the minimum biocidal concentration against *Staphylococcus aureus* for example C. Example 8 is based on example 1, with a didecyl dimethyl ammonium chloride concentration against *Staphylococcus aureus* which is the same as in comparative example G. Example 9 is based on example 1, with a didecyl dimethyl ammonium chloride concentration against *Staphylococcus aureus* which is five times that of the minimum biocidal concentration for example 1. Example 10 is based on example 4, with a didecyl dimethyl ammonium chloride concentration against *Staphylococcus aureus* which is five times that of example 4:

| | Ex F* wt % | Ex G* wt % | Ex. 8 wt % | Ex. 9 wt % | Ex H* wt % | Ex. 10 wt % |
|---|---|---|---|---|---|---|
| C9-11alcohol ethoxylate EO8 | — | — | = | = | 2.25 | 2.25 |
| 2-propylheptyl EO14 alkylalkoxylate | 0.1 | 0.1 | 0.1 | 0.1 | — | — |
| Lauramidopropyl betaine[1] | 0.5 | 0.5 | — | — | — | — |
| Amine 1[2] | — | — | — | — | — | 0.75 |
| Amine 2[3] | — | — | 0.5 | 0.5 | — | — |
| C10 N-methyl glucamide | — | — | — | — | 0.75 | — |
| Didecyl dimethyl ammonium chloride[3] | 0.15 | 0.05 | 0.05 | 0.005 | 0.15 | 0.005 |
| pH (adjusted with minor amounts of HCl or NaOH) | 7 | 7 | 7 | 7 | 7 | 7 |
| Water and minors | To 100% | To 100% | To 100% | To 100% | To 100% | To 100% |
| Neat shine grade (10 panelists) | 2.59 | 1.67 | 0.53 | 0.148 | 3.6 | 2.37 |

*Comparative

[1]Lauramidopropyl betaine (Mackam ® DAB), supplied by Solvay Novecare

[2]Amine of formula I, wherein R1 is CH2 (CHOH)4 CH2OH, R2 is Methyl, and R3 is 2-propylheptyl

[3]Amine of formula I, wherein R1 is CH2 (CHOH)4 CH2OH, R2 is Methyl, and R3 is n-decyl As can be seen from comparing the neat shine grading of examples 8 and 9 in comparison to the result for comparative examples F and G, surfaces treated with compositions comprising the amine surfactant of formula I show improved shine performance than composition comprising lauramidopropyl betaine, whether the composition comprised the same level of antimicrobial agent (example 8 in comparison to comparative example G), or whether the composition provided similar antimicrobial efficacy (example 9 in comparison to comparative example F and G, see earlier minimum biocidal concentrations in earlier table).

As can be seen from comparing the neat shine grading of example 10 in comparison to the result for comparative example H, surfaces treated with compositions comprising the amine surfactant of formula I show improved shine performance versus compositions comprising C10 N-methyl glucamide, while still providing more than the desired antimicrobial efficacy (see earlier minimum biocidal concentrations in earlier table).

The following are exemplary formulae of the present invention, which can be applied to hard surfaces in both neat and diluted form.

| | 11 wt % | 12 wt % | 13 wt % | 14 wt % | 15 wt % |
|---|---|---|---|---|---|
| C10 dimethyl amine oxide[1] | — | 0.4 | — | — | — |
| C12-14 dimethyl amine oxide | 0.1 | | 1.5 | — | — |
| C9-11alcohol ethoxylate EO8 | — | 2 | — | — | — |

-continued

| | 11 wt % | 12 wt % | 13 wt % | 14 wt % | 15 wt % |
|---|---|---|---|---|---|
| Alkylpolyglucoside[2] | 0.3 | — | — | 2 | — |
| Cocoamidopropyl hydroxysultaine[3] | — | — | — | — | 0.2 |
| Amine 1[4] | 0.3 | 0.6 | 0.5 | 1 | 0.2 |
| 50:50 Blend of alkyl dimethyl benzyl ammonium chloride and alkyl dimethyl ethylbenzyl ammonium chloride | 0.07 | — | 0.1 | 0.2 | — |
| Didecyl dimethyl ammonium chloride[6] | — | 0.15 | — | — | 0.04 |
| Citric acid | — | 0.2 | 0.3 | — | 0.2 |
| Sodium carbonate | 0.1 | 0.5 | — | 0.3 | — |
| Monoethanolamine | 0.4 | 0.35 | — | 0.4 | 0.2 |
| Chelant | 0.2 | 0.1 | 0.05 | — | 0.1 |
| Perfume | 0.5 | 0.3 | 0.7 | 0.4 | 0.2 |
| pH (trimmed with NaOH or HCl) | 10.5 | 11 | 7 | 11.1 | 8 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An antimicrobial hard surface cleaning composition comprising:

a. from about 0.05% to about 0.20% by weight of the composition of didecyldimethylammonium chloride as a cationic antimicrobial agent;

b. from about 0.1% to about 15% by weight of the composition of an amine surfactant of formula I:

$$R1\text{-}N\text{—}(R2)(CH2CHOH(CH2O)nR3) \qquad \text{formula I}$$

wherein R1 is CH2(CHOH)4CH2OH, R2 is Methyl, and R3 is 2-propylheptyl; and c) an amine oxide, wherein the composition has a pH of from about 7.0 to about 8.0.

2. The hard surface cleaning composition according to claim 1, wherein the composition further comprises an additional surfactant.

3. The hard surface cleaning composition according to claim 1, wherein the composition comprises the additional surfactant at a level of from about 0.005 wt % to about 9.5 wt % by weight of the composition.

4. The hard surface cleaning composition according to claim 2, wherein the ratio of additional surfactant to the amine of formula I is from about 1:10 to about 10:1.

5. A method of cleaning hard surfaces comprises the steps of:

a. diluting the hard surface cleaning composition according to claim 1, and b. applying the hard surface cleaning composition according to claim 1 to a hard surface.

* * * * *